US008806889B2

(12) United States Patent
Ota et al.

(10) Patent No.: US 8,806,889 B2
(45) Date of Patent: Aug. 19, 2014

(54) EJECTOR TYPE REFRIGERATING CYCLE UNIT

(75) Inventors: Aun Ota, Kariya (JP); Tomohiko Nakamura, Obu (JP); Hideaki Sato, Anjo (JP)

(73) Assignee: Denso Corporation, Kariya (JP)

( * ) Notice: Subject to any disclaimer, the term of this patent is extended or adjusted under 35 U.S.C. 154(b) by 632 days.

(21) Appl. No.: 12/806,593

(22) Filed: Aug. 16, 2010

(65) Prior Publication Data

US 2011/0048064 A1 Mar. 3, 2011

(30) Foreign Application Priority Data

Aug. 28, 2009 (JP) ..... 2009-198162

(51) Int. Cl.

| | |
|---|---|
| ***F25B 39/02*** | (2006.01) |
| ***F28D 1/03*** | (2006.01) |
| ***F25B 41/00*** | (2006.01) |
| *F28D 21/00* | (2006.01) |

(52) U.S. Cl.

CPC ..... *F25B 41/00* (2013.01); *F28D 1/0333* (2013.01); *F28D 2021/0085* (2013.01); *F25B 39/022* (2013.01); *F25B 2500/18* (2013.01); *F25B 2341/0011* (2013.01)

USPC ..... 62/515; 62/500; 62/524; 62/525; 62/526

(58) Field of Classification Search

USPC ..... 62/526, 515, 524, 525, 523, 500

See application file for complete search history.

(56) References Cited

U.S. PATENT DOCUMENTS

| | | | | | |
|---|---|---|---|---|---|
| 4,595,344 | A | * | 6/1986 | Briley | 417/185 |
| 5,701,760 | A | * | 12/1997 | Torigoe et al. | 62/524 |
| 5,735,343 | A | * | 4/1998 | Kajikawa et al. | 165/153 |
| 5,931,020 | A | * | 8/1999 | Nakamura | 62/527 |
| 6,742,577 | B2 | * | 6/2004 | Joboji et al. | 165/153 |
| 6,904,769 | B2 | * | 6/2005 | Ogata et al. | 62/500 |
| 7,222,663 | B2 | * | 5/2007 | Higashiyama | 165/153 |
| 7,254,961 | B2 | * | 8/2007 | Oshitani et al. | 62/500 |

(Continued)

FOREIGN PATENT DOCUMENTS

| | | | |
|---|---|---|---|
| JP | 2008-45775 | | 2/2008 |
| JP | 2008045775 | A * | 2/2008 |
| JP | 2008-304116 | | 12/2008 |
| JP | 2009-121804 | | 6/2009 |

OTHER PUBLICATIONS

Office action dated Mar. 26, 2013 in corresponding Japanese Application No. 2009-198162.

*Primary Examiner* — Cheryl J Tyler
*Assistant Examiner* — Raheena Rehman
(74) *Attorney, Agent, or Firm* — Harness, Dickey & Pierce, P.L.C.

(57) ABSTRACT

A refrigerating cycle unit includes an ejector and a heat exchanger defined by layering a plurality of plates. Each of the plates has a refrigerant passage, and the refrigerant passages are connected by a header tank in a layering direction of the plates. At least two of the plates are fix plates having a fix portion to fix the ejector, and a communication portion through which the ejector and the header tank communicate with each other. The ejector is arranged between the fix portions of the fix plates in the layering direction, so as to be integrated with the heat exchanger.

15 Claims, 12 Drawing Sheets

(56) References Cited

U.S. PATENT DOCUMENTS

| | | | | |
|---|---|---|---|---|
| 2004/0159121 | A1* | 8/2004 | Horiuchi et al. | 62/526 |
| 2007/0163294 | A1* | 7/2007 | Aung et al. | 62/500 |
| 2007/0169510 | A1* | 7/2007 | Ishizaka et al. | 62/500 |
| 2007/0169511 | A1* | 7/2007 | Ishizaka et al. | 62/500 |
| 2007/0169512 | A1* | 7/2007 | Ishizaka et al. | 62/515 |
| 2008/0264097 | A1* | 10/2008 | Ishizaka et al. | 62/500 |
| 2008/0314074 | A1* | 12/2008 | Nakamura et al. | 62/500 |
| 2009/0107171 | A1 | 4/2009 | Brodie et al. | |

* cited by examiner

EJECTOR TYPE REFRIGERATING CYCLE UNIT

CROSS REFERENCE TO RELATED APPLICATION

This application is based on Japanese Patent Application No. 2009-198162 filed on Aug. 28, 2009, the disclosure of which is incorporated herein by reference in its entirety.

BACKGROUND OF THE INVENTION

1. Field of the Invention

The present invention relates to a refrigerating cycle unit having an ejector.

2. Description of Related Art

JP-A-2008-45775 discloses an ejector type refrigerating cycle unit. The unit includes an ejector and a layered type heat exchanger. The ejector has a nozzle to inject refrigerant at high speed, and is a fluid pump to draw refrigerant from a suction port due to the high speed refrigerant flow. The injected refrigerant and the drawn refrigerant are mixed with each other, and the mixed refrigerant is discharged from an outlet of the ejector.

The heat exchanger has a first refrigerant passage and a second refrigerant passage so as to evaporate refrigerant. Refrigerant to be drawn through the suction port flows through the first refrigerant passage, and refrigerant discharged from the outlet flows through the second refrigerant passage. The heat exchanger is an evaporator constructed by plural flat plates layered with each other. The heat exchanger is integrated with the ejector by arranging the ejector inside of a gather tank of the heat exchanger. Refrigerant flowing through the first refrigerant passage is gathered by the gather tank.

However, when the ejector is arranged in the gather tank, a passage area of refrigerant is decreased in the gather tank, such that a pressure loss is increased. In this case, cooling performance of the heat exchanger is lowered.

The ejector may be arranged outside of the gather tank so as to secure the passage area in the gather tank. That is, the heat exchanger and the ejector may be located to be separated from each other.

However, in this case, a pipe is needed to connect the ejector and the gather tank, other than the plates and the ejector. Further, a pipe connecting process is needed to connect the pipe to the ejector, other than a layering process to layer the plates. That is, the unit may have a complicated structure in this case.

SUMMARY OF THE INVENTION

In view of the foregoing and other problems, it is an object of the present invention to provide a refrigerating cycle unit.

According to an example of the present invention, an ejector type refrigerating cycle unit includes an ejector having a nozzle to inject refrigerant, and a heat exchanger. The heat exchanger includes a plurality of heat exchange plates layered with each other, and a header tank. Each of the heat exchange plates has a refrigerant passage through which refrigerant flows to exchange heat with air to be conditioned. The header tank connects the refrigerant passages of the heat exchange plates in a layering direction of the heat exchange plates such that the refrigerant passages communicate with each other. At least two of the heat exchange plates is fix plates having a fix portion to fix an end part of the ejector, and a communication portion through which an inside of the fixed ejector and an inside of the header tank communicate with each other. The ejector is arranged between the fix portions of the fix plates in the layering direction, so as to be integrated with the heat exchanger.

Accordingly, the ejector and the heat exchanger can be integrated with each other without a lowering of cooling performance.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENT

An ejector type refrigerating cycle unit 100 will be described with reference to FIGS. 1-5.

The unit 100 may be an ejector type refrigerating cycle evaporator unit, or an ejector-fixed evaporator unit. The unit 100 is applied to an ejector type refrigerating cycle. The cycle has refrigerant such as chlorofluorocarbon or hydrocarbon (HC). A high pressure of the refrigerant does not exceed a critical pressure, and a vapor compression subcritical cycle is constructed.

The unit 100 is constructed by integrating an ejector 10 and a layered heat exchanger 20.

The ejector 10 is a decompressor to decompress refrigerant, and is a refrigerant circulator corresponding to a momentum transport type pump. Refrigerant is circulated by drawing and inclusion operation of refrigerant flow ejected at a high speed from the ejector 10.

Figure 5:
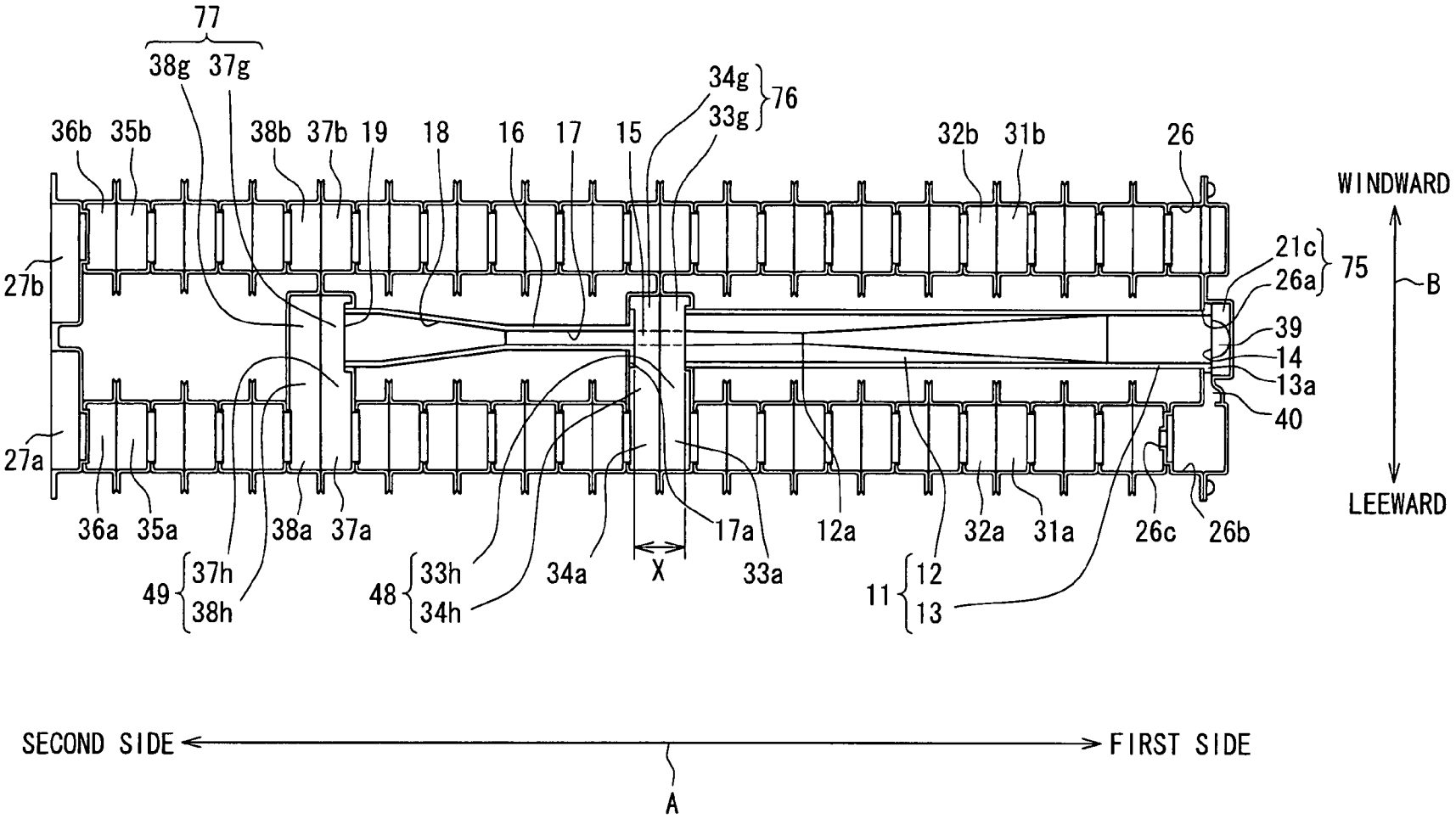
FIG. 5 is a cross-sectional view taken along line V-V of FIG. 3.

As shown in FIG. 5, the ejector 10 has a nozzle 12*a* and a refrigerant suction port 15. A passage area of middle-pressure refrigerant passing through an expansion valve (not shown) is made narrower by the nozzle 12*a*, such that refrigerant is further decompressed and expanded. The suction port 15 is located in the same space as a refrigerant injection outlet of the nozzle 12*a*, and draws gas phase refrigerant from the heat exchanger 20.

The ejector 10 further has a mixer 17 located downstream of the nozzle 12*a* and the suction port 15 in the refrigerant flowing direction. The high speed refrigerant flowing from the nozzle 12*a* and the refrigerant drawn from the suction port 15 are mixed in the mixer 17.

A diffuser 18 corresponding to a pressor member is arranged downstream of the mixer 17 in the refrigerant flowing direction. The passage area of refrigerant is gradually increased in the diffuser 18. Due to the diffuser 18, a refrigerant speed is lowered, and a refrigerant pressure is raised, such that speed energy of refrigerant is converted into pressure energy. That is, the speed energy of refrigerant is recovered by the ejector 10 as the pressure energy.

The ejector 10 is constructed by a nozzle portion 11 and a mixture portion 16, and the nozzle portion 11 and the mixture portion 16 are separated from each other by the suction port 15. The nozzle portion 11 has the nozzle 12*a*, and the mixture portion 16 has the mixer 17 and the diffuser 18. The suction port 15 is open, and has a side face shape of a cylinder.

The nozzle portion 11 has an inside tube 12 and an outside tube 13. The nozzle 12*a* is defined by an inner circumference face of the inside tube 12. Refrigerant flows into the inside tube 12 through a first side opening, and flows out of the inside tube 12 through a second side opening. A diameter of the first side opening is larger than a diameter of the second side opening.

The outside tube 13 has a flange 13*a* extending outward in a radial-direction of the tube 13. Refrigerant flows into the outside tube 13 through a first side opening, and the flange 13*a* is located on the first side opening. The outside tube 13 has a refrigerant inlet 14 through which refrigerant flows into the nozzle 12*a*, and the inlet 14 is located most upstream of the outside tube 13 in the refrigerant flowing direction.

The inside tube 12 is fixed inside of the outside tube 13 by being fitted. A second side face of the inside tube 12 and a second side face of the outside tube 13 are located on approximately the same plane.

The mixture portion 16 has a tube shape having a uniform thickness. The mixture portion 16 has a flange 17*a* extending outward in the radial direction. Refrigerant flows into the mixture portion 16 from a first side, and the flange 17*a* is located on the first side. The mixer 17 of the mixture portion 16 is located on the first side, and the diffuser 18 of the mixture portion 16 is located on a second side opposite from the first side. A passage area of the mixer 17 is constant, and a passage area of the diffuser 18 is gradually increased toward the second side.

The diffuser 18 has a refrigerant outlet 19 through which refrigerant flows out of the diffuser 18, and the outlet 19 is located most downstream in the refrigerant flowing direction. A diameter of a first side opening of the mixture portion 16 is smaller than that of a second side opening of the mixture portion 16, and is approximately the same as a diameter of a second side opening of the inside tube 12 of the nozzle portion 11.

The nozzle portion 11 and the mixture portion 16 are separated from each other through a clearance X defined between the second side face of the nozzle portion 11 and the first side face of the mixture portion 16. The suction port 15 is defined by the clearance X.

Figure 2:
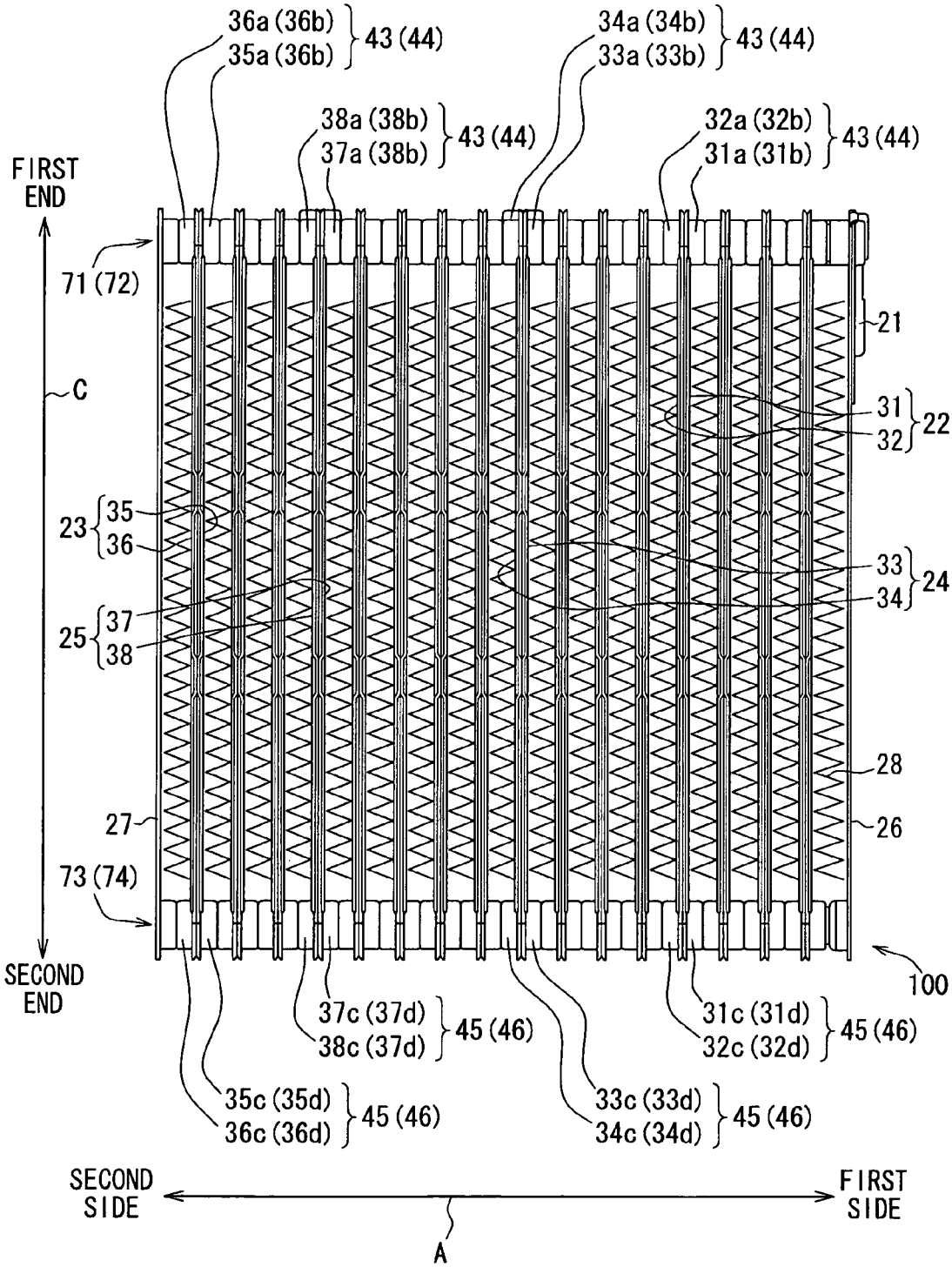
FIG. 2 is a front view illustrating the refrigerating cycle unit.
Figure 3:
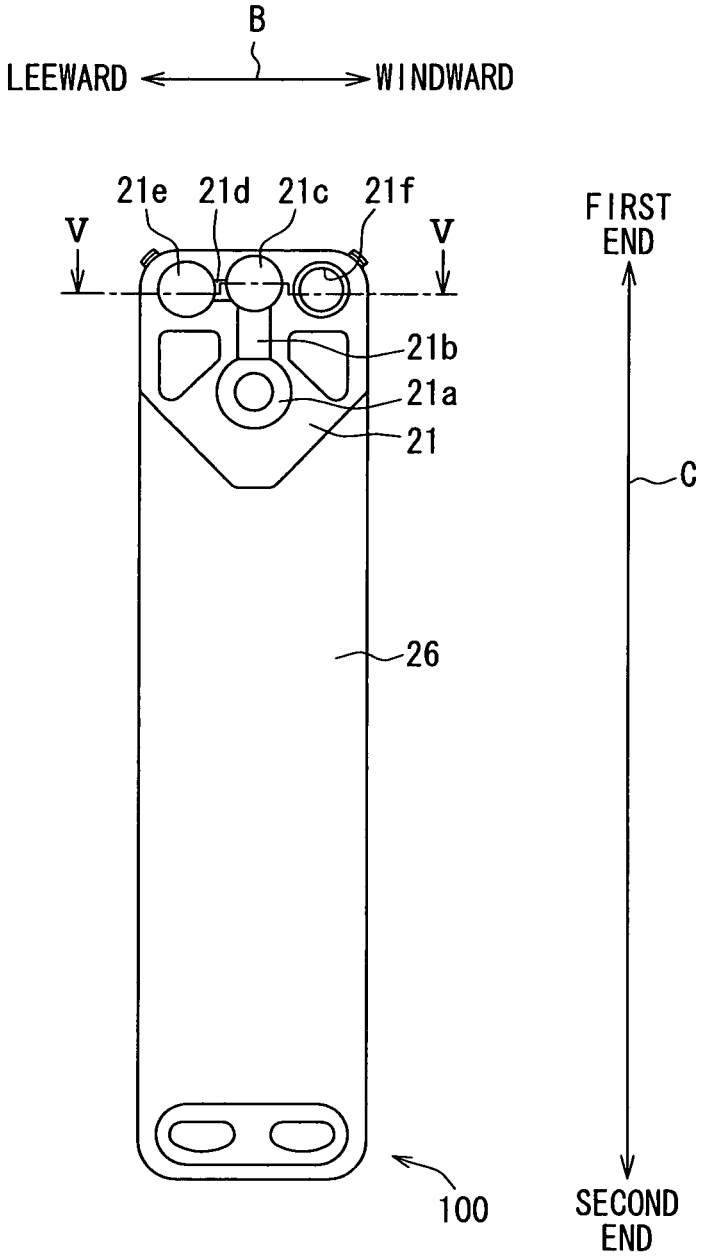
FIG. 3 is a side view illustrating the refrigerating cycle unit.

As shown in FIG. 2, the heat exchanger 20 is defined by layering a distribution plate 21, first and second heat exchange plates 22 and 23, first and second fix plates 24 and 25, first and second side plates 26 and 27, and fins 28.

Figure 4:
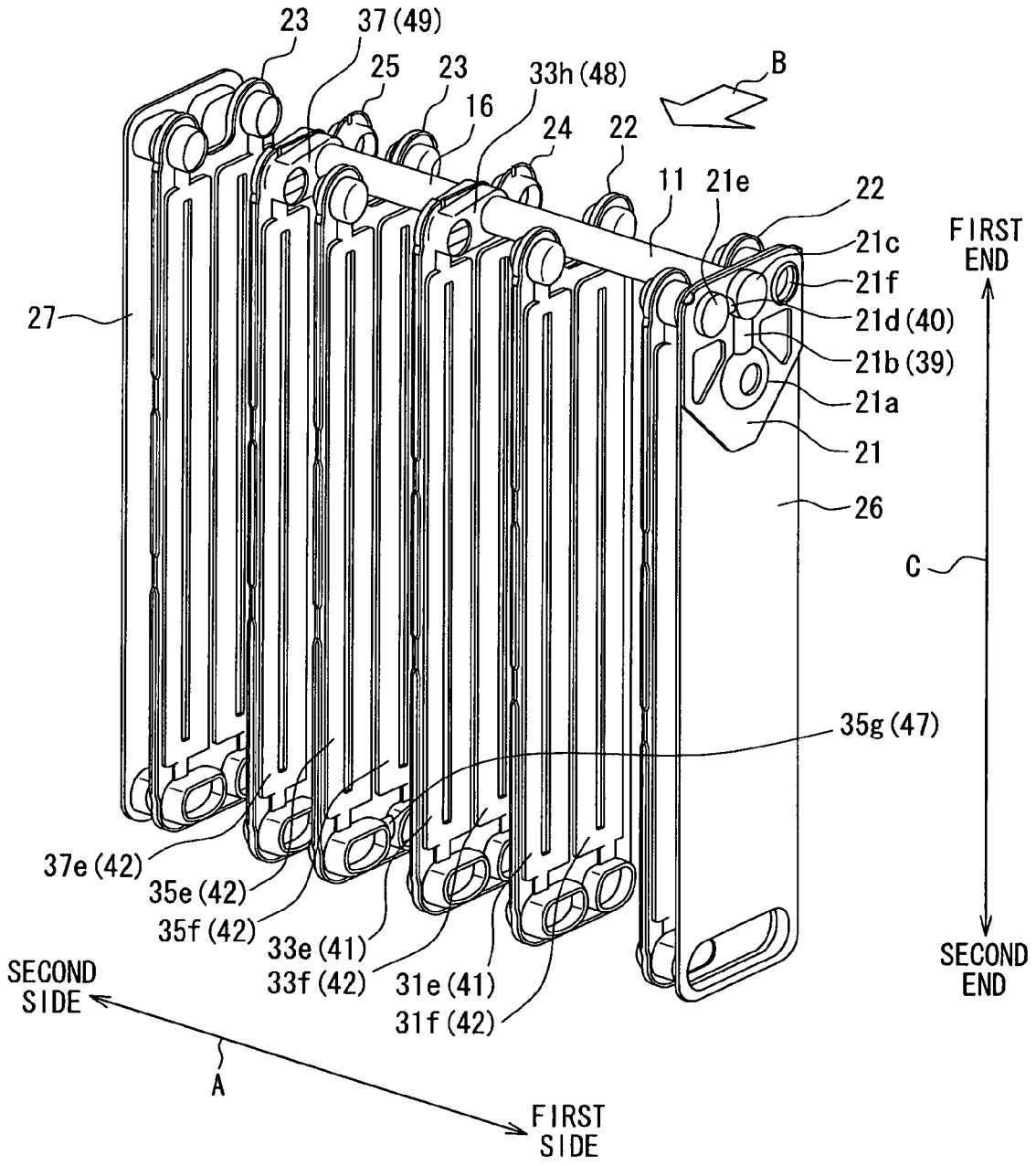
FIG. 4 is a schematic exploded perspective view illustrating the refrigerating cycle unit.

As shown in FIG. 4, the heat exchanger 20 has a first refrigerant passage 41 and a second refrigerant passage 42. Refrigerant to be drawn into the suction port 15 of the ejector 10 flows through the first passage 41 so as to evaporate. Refrigerant flowing out of the outlet 19 of the ejector 10 flows through the second passage 42 so as to evaporate.

Figure 1:
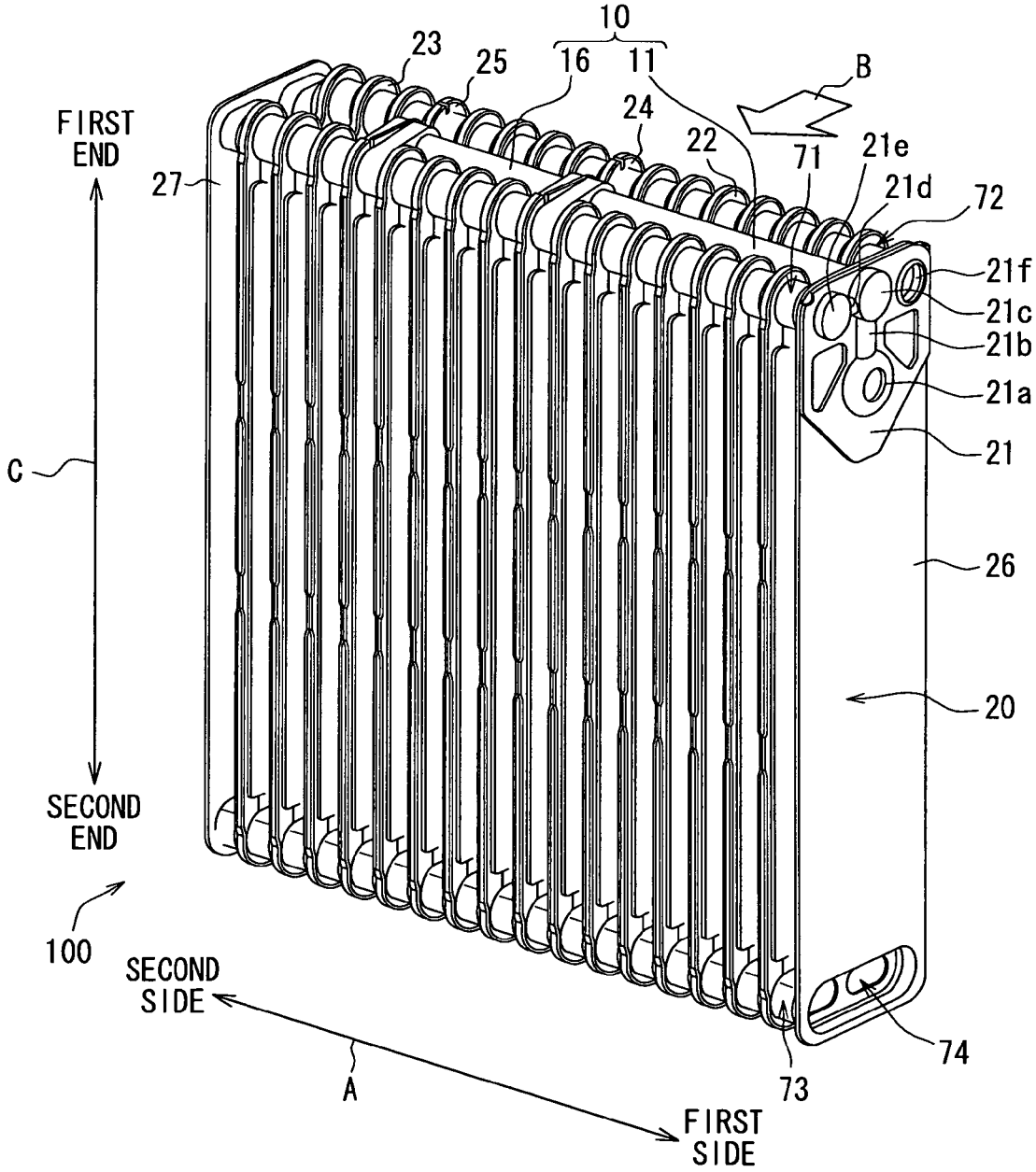
FIG. 1 is a perspective view illustrating a refrigerating cycle unit according to an embodiment of the present invention.

Air to be conditioned and blown into a passenger compartment of a vehicle exchanges heat with refrigerant in the heat exchanger 20. As shown in FIG. 1, first, second, third and fourth header tanks 71, 72, 73 and 74 are defined by layering the plates 21-27 so as to distribute or gather refrigerant. The header tanks 71, 72, 73 and 74 are defined by layering tanks 43, 44, 45 and 46, respectively, as shown in FIG. 2.

As shown in FIG. 1, the distribution plate 21 is a five-cornered board member, and is located at a first side end of a layering direction A. The distribution plate 21 has an inlet 21*a*, a main passage groove 21*b*, a concave portion 21*c* for ejector, a branch passage groove 21*d*, a Concave portion 21*e* for first tank, and an outlet 21*f*.

The inlet 21*a* is located approximately center of the distribution plate 21. The inlet 21*a* is recessed on the first side of the layering direction A without a base, and has a round opening. Refrigerant flows into the unit 100 through the inlet 21*a*.

The concave portion 21*c* is located approximately center of the distribution plate 21 in a flowing direction B of air. The concave portion 21*c* is located on a first end part of the plate 21 in a plate longitudinal direction C. The longitudinal direction C is approximately perpendicular to the layering direction A and the air flowing direction B.

The concave portion 21*c* is recessed on the first side of the layering direction A, and has a based cylinder shape. A diameter of the concave portion 21*c* for ejector is larger than a diameter of the concave portion 21*e* for, first tank. The longitudinal direction C corresponds to a vertical direction. The first end of the longitudinal direction C is located on an upper side in the vertical direction.

The concave portion 21*e* for first tank is located leeward of the plate 21 in the air flowing direction B, and is located on a first end part of the plate 21 in the longitudinal direction C. The concave portion 21*e* is recessed on the first side of the layering direction A, and has a based cylinder shape.

The outlet 21*f* is located windward of the plate 21 in the air flowing direction B, and is located on a first end part of the plate 21 in the longitudinal direction C. The outlet 21*f* is recessed on the first side of the layering direction A without a base, and has a round opening. Refrigerant flows out of the unit 100 through the outlet 21*f*.

The concave portions 21*c*, 21*e* and the outlet 21*f* are located approximately the same position in the longitudinal direction C. The concave portion 21*c* is located between the concave portion 21*e* and the outlet 21*f* in the air flowing direction B.

The inlet 21*a* and the concave portion 21*c* communicate with each other through the main groove 21*b*, and the main groove 21*b* defines a main passage 39 of FIG. 4. The main groove 21*b* extends in the longitudinal direction C, and is recessed on the first side of the layering direction A. The main passage 39 defined by the main groove 21*b* has a semicircle-shaped cross-section.

The branch groove 21*d* defines a branch passage 40 through which the concave portions 21*c*, 21*e* communicate with each other. The branch groove 21*d* extends in the air flowing direction B, and is recessed on the first side of the layering direction A. The branch passage 40 defined by the branch groove 21*d* has a semicircle-shaped cross-section. The branch passage 40 may correspond to a communication portion.

The inlet 21*a* communicates with the concave portion 21*c* through the main groove 21*b*. The concave portion 21*c* communicates with the concave portion 21*e* through the branch groove 21*d*.

The first side plate 26 is layered on the second side of the distribution plate 21 in the layering direction A. The first side plate 26 increases a strength of the heat exchanger 20.

Figure 6:
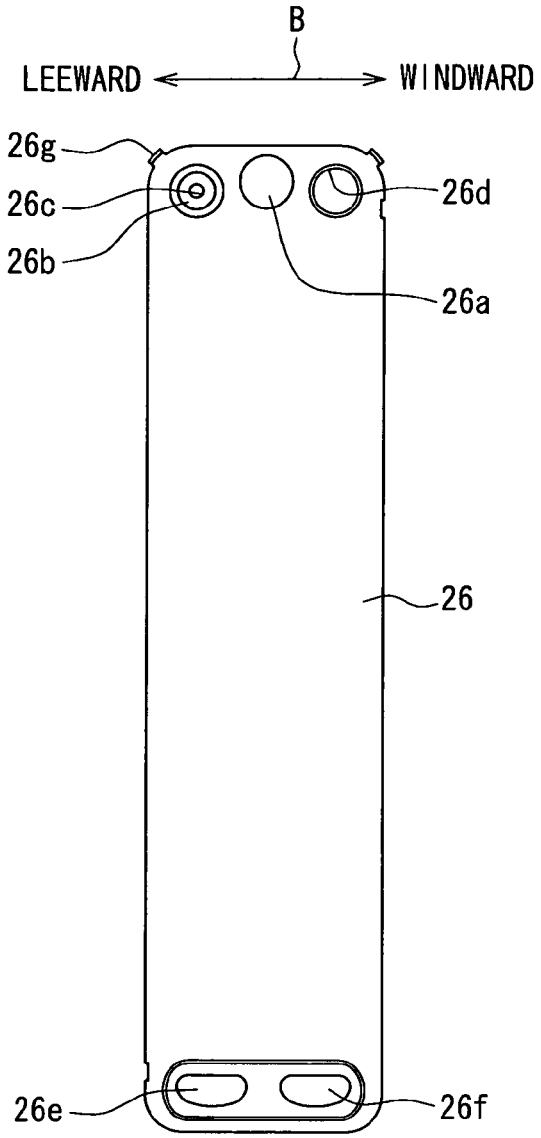
FIG. 6 is a front view illustrating a first side plate of the unit.

As shown in FIG. 6, the first side plate 26 is a flat rectangular board having a concave portion 26*a* for ejector, first, second, third and fourth concave portions 26*b*, 26*d*, 26*e* and 26*f* for tank, and a nail 26*g*. A position of the concave portion 26*a* corresponds to a position of the concave portion 21*c* of the distribution plate 21. A position of the concave portion 26*b* corresponds to a position of the concave portion 21*e* of the distribution plate 21. A position of the concave portion 26*d* corresponds to a position of the outlet 21*f* of the distribution plate 21.

The concave portion 26*a* for ejector is located approximately center of the plate 26 in the air flowing direction B, and is located on a first end part of the plate 26 in the longitudinal direction C. The concave portion 26*a* has a through hole through which the nozzle portion 11 is inserted from the first side to the second side in the layering direction A, and the nozzle portion 11 is fixed by the concave portion 26*a*. The through hole defined by the concave portion 26*a* has a round shape.

As shown in FIG. 5, a diameter of the through hole is smaller than the outer diameter of the flange 13*a*. The concave portion 26*a* is contact with the flange 13*a* on a face approximately perpendicular to the layering direction A. The positioning of the nozzle portion 11 is performed by the concave portion 26*a* in the layering direction A. The concave portion 26*a* is closed by the concave portion 21*c* of the distribution plate 21. That is, the concave portion 21*c* of the distribution plate 21 corresponds to a lid of the concave portion 26*a* of the first side plate 26. A first fix portion 75 for ejector is defined by layering the concave portions 26*a*, 21*c*. An end part of the nozzle portion 11 adjacent to the inlet 14 is fixed by the first fix portion 75.

As shown in FIG. 6, the concave portion 26*b* for first tank is located leeward of the plate 26 in the air flowing direction B, and is located on a first end part of the plate 26 in the longitudinal direction C.

Figure 7:
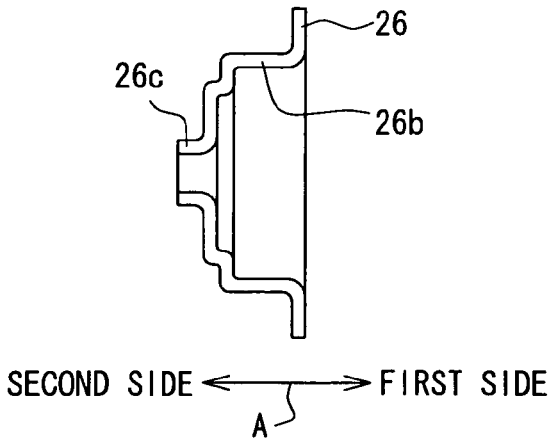
FIG. 7 is a cross-sectional view illustrating a concave portion for first tank of the first side plate.

As shown in FIG. 7, the concave portion 26*b* of the first side plate 26 is recessed on the second side of the layering direction A, and has a cylinder shape. A throttle hole 26*c* is located approximately center of a base of the concave portion 26*b*. The throttle hole 26*c* is a decompressor to control a flowing amount of refrigerant passing through the throttle hole 26*c*. The throttle hole 26*c* has a nozzle shape protruding toward the second side of the layering direction A. Refrigerant inlet side of the throttle hole 26*c* has a mild curved surface connected to a flat face of the first side plate 26.

As shown in FIG. 5, the throttle hole 26*c* is located downstream of the concave portion 26*a* in the refrigerant flowing direction. The first tank 43 is defined by layering the concave portions 26*b*, 21*e*.

As shown in FIG. 6, the concave portion 26*d* for second tank is located windward of the plate 26 in the air flowing direction B, and is located on a first end part of the plate 26 in the longitudinal direction C.

As shown in FIG. 5, the concave portion 26*d* is recessed on the second side of the layering direction A into a cylinder shape without a base. That is, the concave portion 26*d* has a round opening. The second tank 44 is defined by layering the concave portion 26*d* of the first side plate 26 and the outlet 21*f* of the distribution plate 21.

As shown in FIG. 6, the concave portions 26*a*, 26*b*, 26*d* are located approximately the same position in the longitudinal direction C. The concave portion 26*a* is located between the concave portion 26*b* and the concave portion 26*d* in the air flowing direction B.

The concave portion 26*e* for third tank is located leeward of the plate 26 in the air flowing direction B, and is located on a second end part of the plate 26 in the longitudinal direction C. The concave portion 26*e* is recessed on the second side of the layering direction A, and has a based cylinder shape. A base of the concave portion 26*e* has an ellipse shape.

The concave portion 26*f* for fourth tank is located windward of the plate 26 in the air flowing direction B, and is located on a second end part of the plate 26 in the longitudinal direction C. The concave portion 26*f* is recessed on the second side of the layering direction A, and has a based cylinder shape. A base of the concave portion 26*f* has an ellipse shape.

The nail 26*g* is arranged on a first end part of the plate 26 in the longitudinal direction C, and is located on both ends of the plate 26 in the air flowing direction B. The nail 26*g* is an engaging portion to be used for temporally fixing the distribution plate 21 to the first side plate 26. The nail 26*g* is bent toward the first side of the layering direction A. The distribution plate 21 and the first side plate 26 are integrated with each other, and may correspond to a heat exchange plate.

A center part of the plate 26 in the longitudinal direction C is flat.

As shown in FIG. 2, a plurality of the plates 22 is layered on the second side of the first side plate 26 in the layering direction A. For example, nine of the plates 22 are layered. The plate 22 has a first board member 31 and a second board member 32 layered with each other in the layering direction A. The tanks 43, 44, 45 and 46 and the refrigerant passages 41 and 42 are defined by layering the board members 31, 32.

Figure 8:
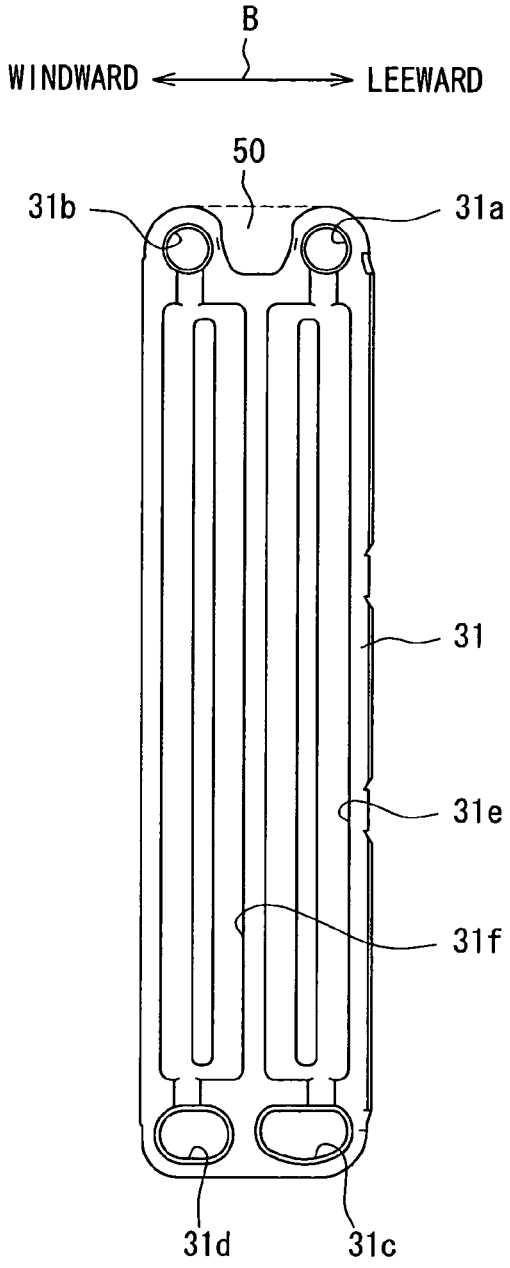
FIG. 8 is a front view illustrating a first board member of a first heat exchange plate of the unit.

As shown in FIG. 8, the first board member 31 is a flat approximately rectangular board having first, second, third and fourth concave portions 31*a*, 31*b*, 31*c* and 31*d* for tank, a leeward groove 31*e* and a windward groove 31*f*. When the first board member 31 located most first side is layered on the first side plate 26 in the layering direction A, the concave portions 31*a*, 31*b*, 31*c*, 31*d* of the first board member 31 are positioned to correspond to the concave portions 26*b*, 26*d*, 26*e* and 26*f* of the first side plate 26, respectively.

The concave portion 31*a* for first tank is located leeward of the first board member 31 in the air flowing direction B, and is located on a first end part of the board member 31 in the longitudinal direction C. The concave portion 31*a* is recessed on the first side of the layering direction A into a cylinder shape without a base, and has a round opening.

The concave portion 31*b* for second tank is located windward of the first board member 31 in the air flowing direction B, and is located on a first end part of the board member 31 in the longitudinal direction C. The concave portion 31*b* is recessed on the first side of the layering direction A into a cylinder shape without a base, and has a round opening.

The concave portion 31*c* for third tank is located leeward of the first board member 31 in the air flowing direction B, and is located on a second end part of the board member 31 in the longitudinal direction C. The concave portion 31*c* is recessed on the first side of the layering direction A into a cylinder shape without a base, and has an ellipse opening. When the first board member 31 located most first side is layered on the first side plate 26 in the layering direction A, the opening of the concave portion 31*c* is closed by the concave portion 26*e* of the first side plate 26.

The concave portion 31*d* for fourth tank is located windward of the first board member 31 in the air flowing direction B, and is located on a second end part of the board member 31 in the longitudinal direction C. The concave portion 31*d* is recessed on the first side of the layering direction A into a cylinder shape without a base, and has an ellipse opening. When the first board member 31 located most first side is layered on the first side plate 26 in the layering direction A, the opening of the concave portion 31*d* is closed by the concave portion 26*f* of the first side plate 26.

The leeward groove 31*e* is located leeward of the first board member 31 in the air flowing direction B, and is located approximately center of the board member 31 in the longitudinal direction C. The leeward groove 31*e* extends in the longitudinal direction C, and the concave portions 31*a*, 31*c* communicate with each other through the groove 31*e*. The leeward groove 31*e* is branched into two lines, for example.

The windward groove 31*f* is located windward of the first board member 31 in the air flowing direction B, and is located approximately center of the board member 31 in the longitudinal direction C. The windward groove 31*f* extends in the longitudinal direction C, and the concave portions 31*b*, 31*d* communicate with each other through the groove 31*f*. The windward groove 31*f* is branched into two lines, for example.

A cutout 50 is defined on a first end part of the board member 31 in the longitudinal direction C, and is located approximately center of the first board member 31 in the air flowing direction B. The cutout 50 is a clearance defined between the concave portions 31*a*, 31*b*. A size of the cutout 50 is larger than a cross-section area of the outside tube 13 of the nozzle portion 11 of the ejector 10. An area of the cutout 50 is larger than a base area of the concave portion 31*a*, 31*b*.

Figure 9:
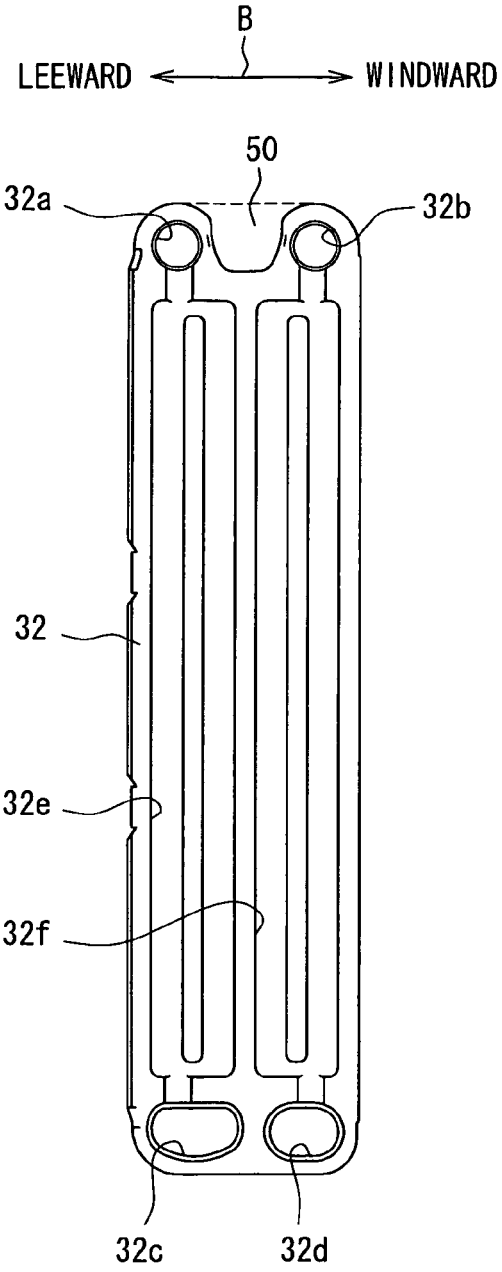
FIG. 9 is a front view illustrating a second board member of the first heat exchange plate.

As shown in FIG. 9, the second board member 32 has first, second, third and fourth concave portions 32*a*, 32*b*, 32*c*, 32*d* for tank, a leeward groove 32*e*, a windward groove 32*f*, and a cutout 50. A shape of the second board member 32 is symmetrical to a shape of the first board member 31, such that details of the second board member 32 are omitted.

The first heat exchange plate 22 is defined by bonding surfaces of the board members 31, 32. As shown in FIG. 2, the first tank 43 is defined by layering the concave portions 31*a*, 32*a*. The second tank 44 is defined by layering the concave portions 31*b*, 32*b*. The third tank 45 is defined by layering the concave portions 31*c*, 32*c*. The fourth tank 46 is defined by layering the concave portions 31*d*, 32*d*. The first refrigerant passage 41 is defined by layering the grooves 31*e*, 32*e*. The second refrigerant passage 42 is defined by layering the grooves 31*f*, 32*f*.

When the plates 22 are layered, a bottom of the concave portion 31*a*-31*d* of the first board member 31 is contact with a bottom of the concave portion 32*a*-32*d* of the second board member 32 located adjacent to the first board member 31. That is, the tanks 43-46 of the plates 22 located adjacent to each other communicate with each other, respectively.

One of the nine plates 22 has a first board member 31' having a based concave portion 31*a'* and a based concave portion 31*b'*. For example, the first board member 31' corresponding to a first heat exchange plate 22 located fourth order from the first side of the layering direction A has the based concave portions 31*a'*, 31*b'*.

Figure 17:
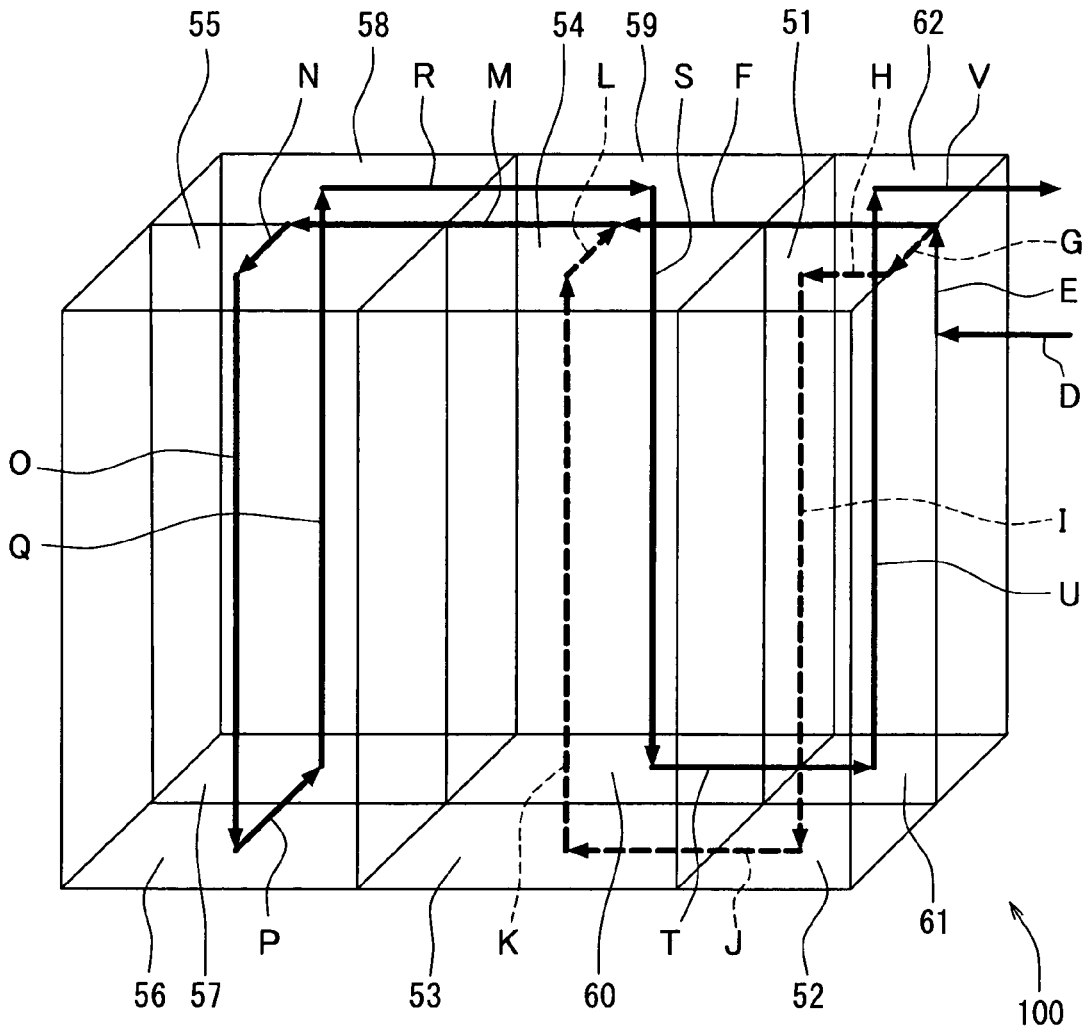
FIG. 17 is a view illustrating refrigerant flow in the refrigerating cycle unit.

Therefore, as shown in FIG. 17, the first header tank 71 is divided into a first distribution tank 51 and a second gather tank 54 in the layering direction A. The second header tank 72 is divided into a fifth distribution tank 59 and a sixth gather tank 62. The third header tank 73 is divided into a first gather tank 52 and a second distribution tank 53. The fourth header tank 74 is divided into a fifth gather tank 60 and a sixth distribution tank 61.

As shown in FIG. 1, a single of the first fix plate 24 is arranged between the plates 22 layered in the layering direction A, and is located between a seventh order plate 22 from the first side and an eighth order plate 22 from the first side. The first fix plate 24 defines a second fix portion 76 for ejector, the tanks 43-46, and the refrigerant passages 41, 42 by layering third and fourth board members 33, 34 in the layering direction A.

Figure 10:
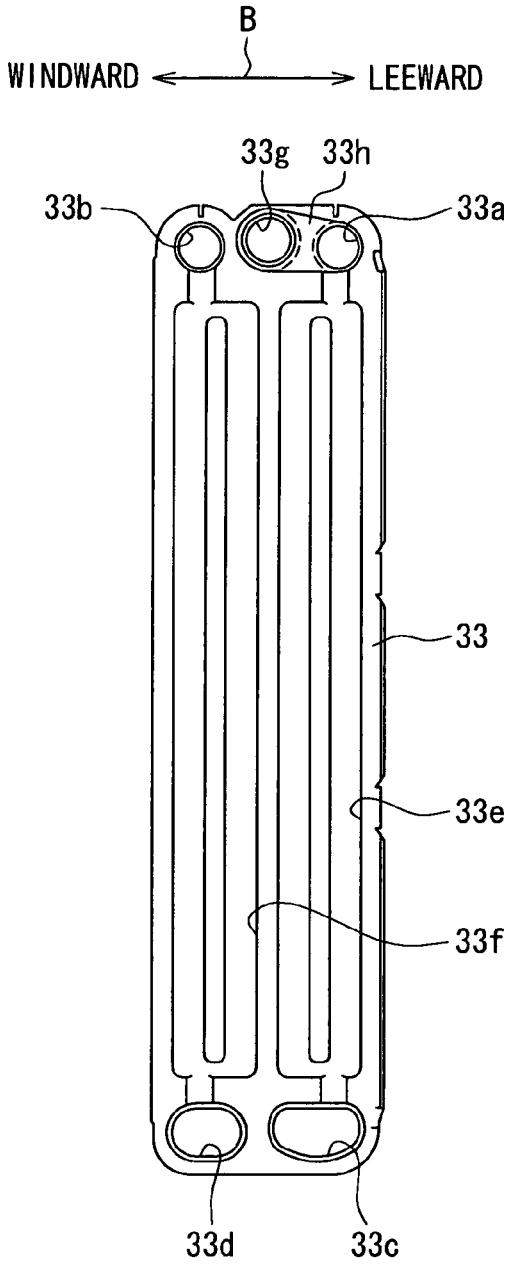
FIG. 10 is a front view illustrating a third board member of a first fix plate of the unit.

As shown in FIG. 10, the third board member 33 is a flat rectangular board having first, second, third and fourth concave portions 33*a*, 33*b*, 33*c*, 33*d* for tank, a leeward groove 33*e*, a windward groove 33*f*, a concave portion 33*g* for ejector and a suction groove 33*h*. The third board member 33 is layered on the plate 22, in a manner that positions of the concave portions 336-33*d* correspond to positions of the concave portions 32*a*-32*d*, respectively.

Compared with the first board member 31, the third board member 33 does not have the cutout 50, and has the concave portion 33*g* for ejector and the suction groove 33*h*. The concave portion 33*a*-33*d* is similar to the concave portion 31*a*-31*d* of the first board member 31. The groove 33*e*, 33*f* is similar to the groove 31*e*, 31*f* of the first board member 31.

The concave portion 33*g* for ejector is located approximately center of the board member 33 in the air flowing direction B, and is located on a first end part of the board member 33 in the longitudinal direction C. The concave portion 33*g* is located between the concave portions 33*a*, 33*b*. The concave portions 33*g*, 33*a* and 33*b* are located approximately the same position in the longitudinal direction C. The concave portion 33*g* is located between the concave portion 33*a* for first tank and the concave portion 33*b* for second tank in the air flowing direction B. The concave portion 33*g* is recessed on the first side of the layering direction A into a cylinder shape without a base, and has a round opening. A diameter of the opening of the concave portion 33*g* for ejector is larger than that of the concave portion 33*a* for first tank.

As shown in FIG. 5, an edge of the opening of the concave portion 33*g* extends from the first side to the second side in the layering direction, and has a tube shape. The extending edge has a shape corresponding to an outer circumference face of the nozzle portion 11 inserted into the concave portion 33*g*.

Therefore; an inner circumference face of the concave portion 33*g*, and an outer circumference face of the nozzle portion 11 are contact in a circumference direction. That is, due to the concave portion 33*g* and the concave portion 26*a* of the first side plate 26, the nozzle portion 11 of the ejector 10 is integrally fixed to the heat exchanger 20. An end face of the extending edge of the concave portion 33*g* and the second side face of the nozzle portion 11 are located on approximately the same plane.

As shown in FIG. 10, the third board member 33 has the suction groove 33*h* through which the concave portions 33*a*, 33*g* communicate with each other. The suction groove 33*h* defines a suction passage 48 through which refrigerant is drawn into the suction port 15 from the second gather tank 54 of the first header tank 43. A cross-sectional area of the groove 33*h* is gradually increased toward the concave portion 33*g* from the concave portion 33*a*. The suction passage 48 may correspond to the communication portion together with the branch passage 40.

Figure 11:
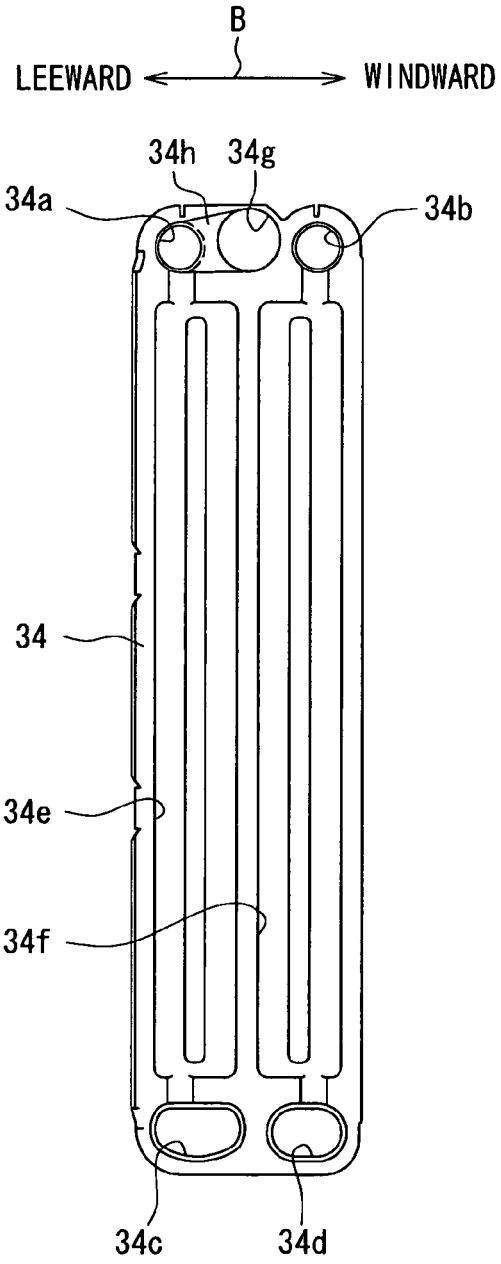
FIG. 11 is a front view illustrating a fourth board member of the first fix plate.

As shown in FIG. 11, the fourth board member 34 has concave portions 34*a*-34*d* for tank, a leeward groove 34*e*, a windward groove 34*f*, a concave portion 34*g* for ejector, and a suction groove 34*h*. A shape of the fourth board member 34 is symmetrical to a shape of the third board member 33, such that details of the fourth board member 34 are omitted.

The concave portion 34*g* of the fourth board member 34 is a round through hole to fix the mixture portion 16 when the mixture portion 16 is inserted from the first side to the second side in the layering direction A. A diameter of the through hole is smaller than an outer diameter of the flange 17*a* of the mixture portion 16. The concave portion 34*g* contacts with the flange 17*a* on a face approximately perpendicular to the layering direction A. Positioning of the mixture portion 16 is performed by the concave portion 34*g* in the layering direction A.

The first fix plate 24 is defined by bonding surfaces of the third and fourth board members 33, 34. The first tank 43 is defined by layering the concave portions 33*a*, 34*a*. The second tank 44 is defined by layering the concave portions 33*b*, 34*b*. The third tank 45 is defined by layering the concave portions 33*c*, 34*c*. The fourth tank 46 is defined by layering the concave portions 33*d*, 34*d*. The first refrigerant passage 41 is defined by layering the grooves 33*e*, 34*e*. The second refrigerant passage 42 is defined by layering the grooves 33*f*, 34*f*.

A second fix portion 76 for ejector is integrally defined by layering the concave portions 33*g*, 34*g* of the board members 33, 34 of the first fix plate 24. The second fix portion 76 fixes a second side end part of the nozzle portion 11 and a first side end part of the mixture portion 16, in a state that a second side end face of the nozzle portion 11 and a first side end face of the mixture portion 16 are separated from each other through the clearance X. The clearance X is approximately equal to a distance between an opening edge of the concave portion 33*g* and an opening edge of the concave portion 34*g* in the layering direction A.

A plurality of the plates 23 is layered on the second side of the layered plates 22 in the layering direction A. For example, five of the plates 23 are layered. The plate 23 defines the tanks 43-46 and the second refrigerant passage 42 by layering a fifth board member 35 and a sixth board member 36 in the layering direction A.

Figure 12:
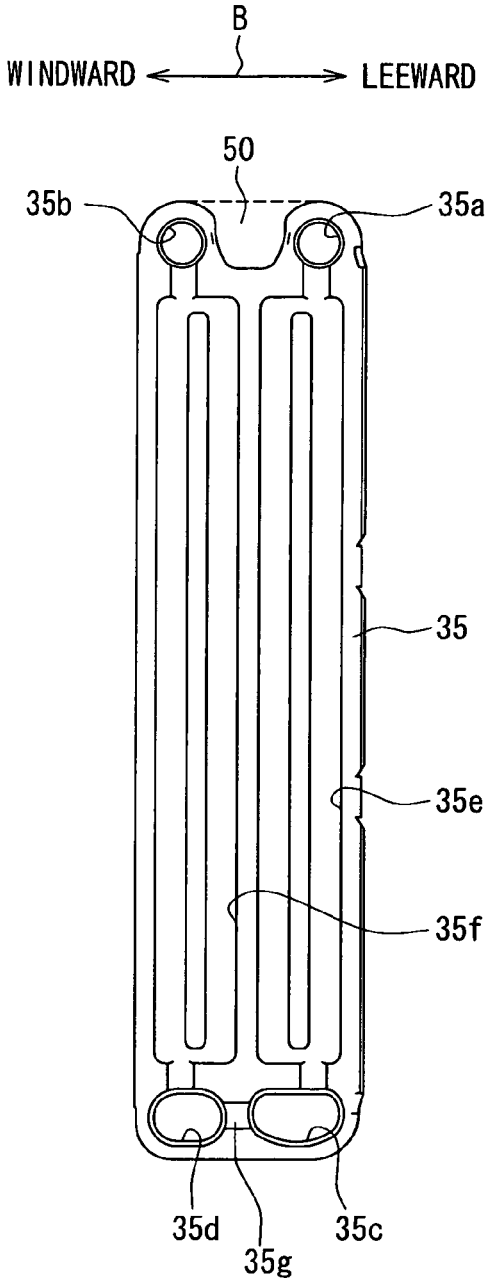
FIG. 12 is a front view illustrating a fifth board member of a second heat exchange plate of the unit.

As shown in FIG. 12, the fifth board member 35 is a flat approximately rectangular board having first, second, third and fourth concave portions 35*a*, 35*b*, 35*c*, 35*d* for tank, a leeward groove 35*e*, a windward groove 35*f* and a communication groove 35*g*. When the fifth board member 35 located most first side is layered on the plate 22 in the layering direction A, the concave portions 35*a*-35*d* are positioned to correspond to the concave portions 32*a*-32*d* of the plate 22 located most second side in the layering direction A, respectively.

Compared with the first board member 31, the fifth board member 35 further has the communication groove 35*g*. The concave portion 35*a*-35*d* is similar to the concave portion 31*a*-31*d* of the first board member 31. The groove 35*e*, 35*f* and the cutout 50 are similar to the groove 31*e*, 31*f* and the cutout 50 of the first board member 31.

The communication groove 35*g* is located approximately center of the board 35 in the air flowing direction B, and is located on a second end part of the board 35 in the longitudinal direction C.

As shown in FIG. 4, the communication groove 35*g* is recessed on the first side of the layering direction A, and defines a communication passage 47.

As shown in FIG. 17, refrigerant flows through the communication passage 47 from the third gather tank 56 corresponding to the third tank 45 into the fourth distribution tank 57 corresponding to the fourth tank 46. The communication groove 35*g* extends in the air flowing direction B, and the concave portions 35*c*, 35*d* communicate with each other through the communication groove 35*g*.

Figure 13:
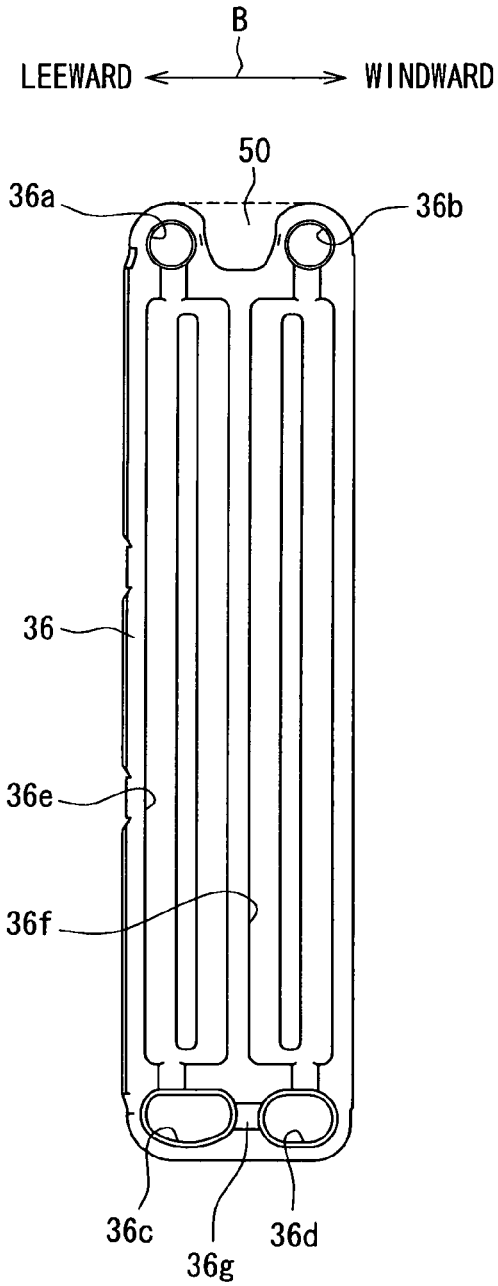
FIG. 13 is a front view illustrating a sixth board member of the second heat exchange plate.

As shown in FIG. 13, the sixth board member 36 has concave portions \ 36*a*-36*d* for tank, a leeward groove 36*e*, a windward groove 36*f*, a cutout 50 and a communication groove 36*g*. The sixth board member 36 is approximately symmetrical to the fifth board member 35. For this reason, details of the sixth board member 36 are omitted.

The second heat exchange plate 23 is defined by bonding surfaces of the fifth and sixth board members 35, 36. The first tank 43 is defined by layering the concave portions 35*a*, 36*a*. The second tank 44 is defined by layering the concave portions 35*b*, 36*b*. The third tank 45 is defined by layering the concave portions 35*c*, 36*c*. The fourth tank 46 is defined by layering the concave portions 35*d*, 36*d*. The first refrigerant passage 41 is defined by layering the grooves 35*e*, 36*e*. The second refrigerant passage 42 is defined by layering the grooves 35*f*, 36*f*.

A plurality of the second heat exchange plates 23 are layered, in a manner that a bottom of the concave portion 35*a*-35*d* of the fifth board member 35 is contact with a bottom of the concave portion 36*a*-36*d* of the sixth board member 36. The tanks 43-46 of the plates 23 located adjacent to each other communicate with each other, respectively.

For example, five of the plates 23 are layered in the unit 100. The plate 23 located most first side has a fifth board member 35' having based concave portions 35*a*', 35*c*', 35*d*'. Therefore, as shown in FIG. 17, the first header tank 71 is divided into a second gather tank 54 and a third distribution tank 55 in the layering direction A. The second header tank 72 is divided into a fourth gather tank 58 and a fifth distribution tank 59. The third header tank 73 is divided into a second distribution tank 53 and a third gather tank 56. The fourth header tank 74 is divided into a fourth distribution tank 57 and a fifth gather tank 60.

A single of the second fix plate 25 is arranged between the plates 23 layered in the layering direction A, and is located between the second order plate 23 from the first side and the third order plate 23 from the first side. The second fix plate 25 defines a third fix portion 77 for ejector, the tanks 43-46 and the second refrigerant passage 42 by layering a seventh board member 37 and an eighth board member 38 in the layering direction A.

Figure 14:
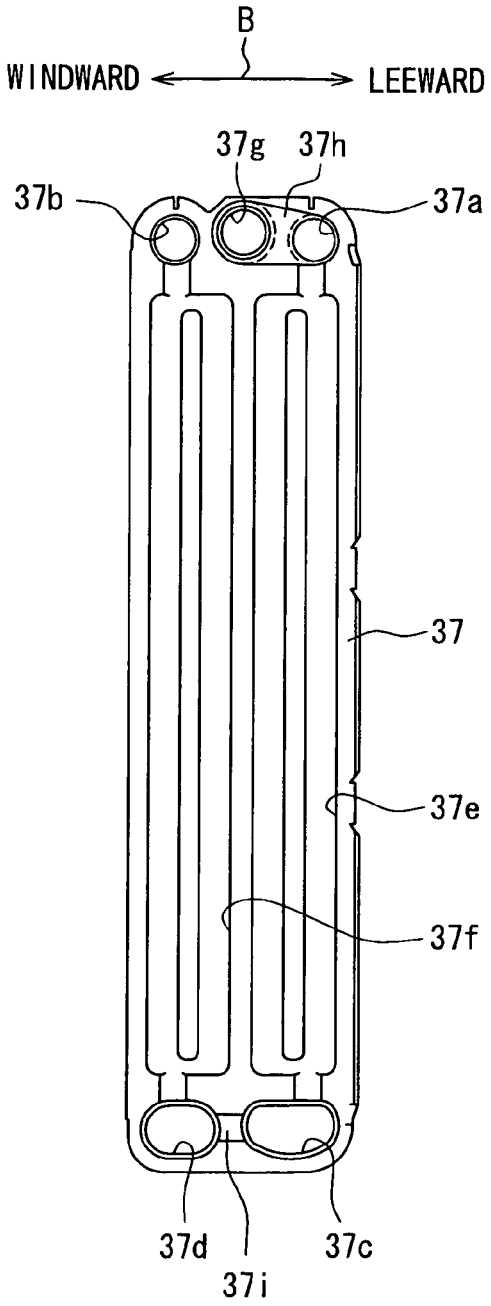
FIG. 14 is a front view illustrating a seventh board member of a second fix plate of the unit.

As shown in FIG. 14, the seventh board member 37 is a rectangular board having first, second, third and fourth concave portions 37*a*-37*d* for tank, a leeward groove 37*e*, a windward groove 37*f*, a concave portion 37*g* for ejector, a discharge groove 37*h* and a communication groove 37*i*. The seventh board member 37 is layered on the plate 23, in a manner that positions of the concave portions 37*a*-37*d* correspond to positions of the concave portions 36*a*-36*d*, respectively.

Compared with the fifth board member 35, the seventh board member 37 does not have the cutout 50, and has the concave portion 37*g* for ejector and the discharge groove 37*h*.

The concave portions 37*a*-37*d* are similar to the concave portions 31*a*-31*d* of the first board member 31, respectively. The grooves 37*e*, 37*f* are similar to the grooves 31*e*, 31*f* of the first board member 31, respectively. The concave portion 37*g* and the discharge groove 37*h* are similar to the concave portion 33*g* and the suction groove 33*h* of the third board member 33, respectively. The communication groove 37*i* is similar to the communication groove 35*g* of the fifth board member 35.

The concave portion 37*g* is similar to the concave portion 33*g* of the third board member 33. As shown in FIG. 5, an edge of the opening of the concave portion 37*g* extends from the first side to the second side in the layering direction A. The extending edge has a shape corresponding to an outer circumference face of the mixture portion 16 inserted into the concave portion 37*g*, and has a tube shape.

Therefore, an inner circumference face of the concave portion 37*g*, and an outer circumference face of the mixture portion 16 are contact with each other. Due to the concave portions 37*g*, 34*g*, the mixture portion 16 of the ejector 10 is integrally fixed to the heat exchanger 20. An end face of the extending edge of the concave portion 37*g* and the second side face of the mixture portion 16 are located on approximately the same plane.

The discharge groove 37*h* is similar to the suction groove 33*h*, and the concave portions 37*a*, 37*g* communicate with each other. The discharge groove 37*h* defines a discharge passage 49 to discharge refrigerant from the outlet 19 of the ejector 10 into the third distribution tank 55 of FIG. 17 corresponding to the first tank 43. A cross-sectional area of the discharge groove 37*h* is gradually increased from the concave portion 37*a* toward the concave portion 37*g*. The discharge passage 49 may correspond to the communication portion together with the branch passage 40 and the suction passage 48.

Figure 15:
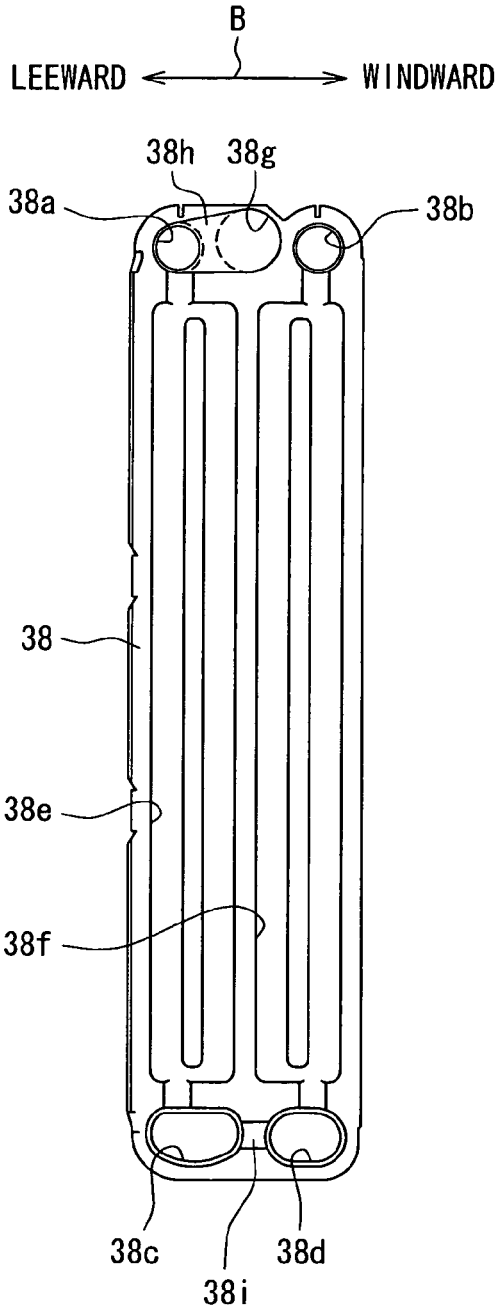
FIG. 15 is a front view illustrating an eighth board member of the second fix plate.

As shown in FIG. 15, the eighth board member 38 has concave portions 38*a*-38*d* for tank, a leeward groove 38*e*, a windward groove 38*f*, a concave portion 38*g* for ejector, a discharge groove 38*h* and a communication groove 38*i*. The eighth board member 38 is approximately symmetrical to the seventh board member 37. For this reason, details of the eighth board 38 are omitted. However, compared with the seventh board member 37, the concave portion 38*g* of the eighth board member 38 has a based structure.

The second fix plate 25 is defined by bonding surfaces of the seventh and eighth board members 37, 38. The first tank 43 is defined by layering the concave portions 37*a*, 38*a*. The second tank 44 is defined by layering the concave portions 37*b*, 38*b*. The third tank 45 is defined by layering the concave portions 37*c*, 38*c*. The fourth tank 46 is defined by layering the concave portions 37*d*, 38*d*. The first refrigerant passage 41 is defined by layering the grooves 37*e*, 38*e*. The second refrigerant passage 42 is defined by layering the grooves 37*f*, 38*f*.

The third fix portion 77 for ejector is integrally formed by layering the concave portions 37*g*, 38*g* of the board members 37, 38 of the second fix plate 25. The third fix portion 77 fixes an end part of the mixture portion 16 adjacent to the outlet 19.

Figure 16:
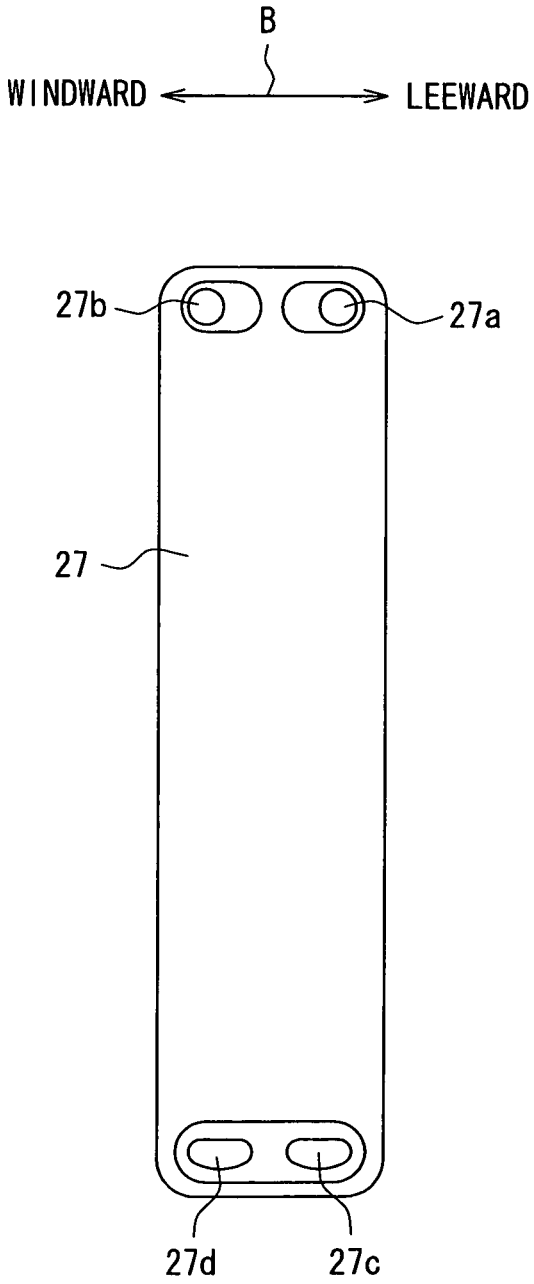
FIG. 16 is a front view illustrating a second side plate of the unit.

The second side plate 27 is layered on the second side of the layered plates 23 in the layering direction A. The second side plate 27 increases a strength of the heat exchanger 20 together with the first side plate 26. As shown in FIG. 16, the second side plate 27 is a flat rectangular board having first, second, third and fourth concave portions 27*a*, 27*b*, 27*c*, 27*d* for tank. The second side plate 27 is layered, on the plate 23 located most second side in the layering direction A, in a manner that positions of the concave portions 27*a*-27*d* correspond to positions of the concave portions 36*a*-36*d* of the plate 23, respectively.

The second side plate 27 has a similar construction as the first side plate 26. However, compared with the first side plate 26, the second side plate 27 does not have a concave portion for ejector and a throttle hole. Further, the concave portion 27*a* for first tank has a based recess shape, and the concave portion 27*b* for second tank has a based recess shape.

The heat exchanger 20 has the header tanks 71, 72, 73, 74 by layering the plates 21-27 in the layering direction A. The first header tank 71 is located leeward in the air flowing direction B, and is located on a first end part in the plate longitudinal direction C. The second header tank 72 is located windward in the air flowing direction B, and is located on a first end part in the plate longitudinal direction C. The third header tank 73 is located leeward in the air flowing direction B, and is located on a second end part in the plate longitudinal direction C. The fourth header tank 74 is located windward in the air flowing direction B, and is located on a second end part in the plate longitudinal direction C. Further, the heat exchanger 20 includes the fins 28 located between the plates 22-27 so as to improve heat exchange ratio between air to be conditioned and refrigerant. The fin 28 may be a corrugated fin, for example.

A method of assembling the ejector type refrigerating cycle unit 100 will be described. The assembling of the unit 100 is started by layering the plates sequentially from the second side of the layering direction A, for example.

First, the second side plate 27 is prepared. Relative to the plate 27, three of the plates 23, the second fix plate 25, two of the plates 23, two of the plates 22 and the fourth board member 34 corresponding to the first fix plate 24 are layered from the first side of the layering direction A. The diffuser 18 of the mixture portion 16 of the ejector 10 is inserted into the concave portion 34*g* of the fourth board member 34 from the first side into the second side.

At this time, the flange 17*a* and the concave portion 34*g* have a face contact. Further, the outer circumference face of the end part of the mixture portion 16 is contact with the inner circumference face of the concave portion 37*g* of the seventh board member 37 corresponding to the second fix plate 25. Further, the end face of the mixture portion 16 and the end face of the concave portion 37*g* are located on approximately the same plane.

Relative to the fourth board member 34, the third board member 33 corresponding to the first fix plate 24, seven of the plates 22 and the first side plate 26 are layered from the first side of the layering direction A. The nozzle portion 11 of the ejector 10 is inserted into the concave portion 26*a* from the first side to the second side in the layering direction A.

At this time, the flange 13*a* and the concave portion 26*a* have a face contact. Further, the outer circumference face of the end part of the nozzle portion 11 is contact with the inner circumference face of the concave portion 33*g* of the third board 33 member corresponding to the first fix plate 24. Further, the second side end face of the nozzle portion 11 and the end face of the concave portion 33*g* are located on approximately the same plane.

The distribution plate 21 is layered on the first side plate 26 from the first side of the layering direction A. The distribution plate 21 is temporally fixed by bending the nail 26*g* of the first side plate 26. Before brazing, the nozzle portion 11 and the mixture portion 16 are supported by the fix plates 24, 25. The temporally fixed structure is held with a proper jig, and is carried into a brazing heating furnace so as to perform an integration brazing. Thus, the ejector 10 and the heat exchanger 20 can be integrally assembled.

As shown in FIG. 17, the unit 100 has a refrigerant flow. An arrow direction E of continuous line represents the main passage 39. An arrow direction G of broken line represent the branch passage 40. Arrow directions H-K of broken line represents the first refrigerant passage 41. An arrow direction L of broken line represents the suction passage 48. An arrow direction N of continuous line represents the discharge passage 49. An arrow direction P of continuous line represents the communication passage 47. Arrow directions O, Q-V of continuous line represent the second refrigerant passage 42.

As shown in an arrow direction D, refrigerant flows into the unit 100 through the inlet 21*a*. After refrigerant flows through the main passage 39 indicated by the direction E, refrigerant is separated into the directions F, G. That is, refrigerant is separated between the ejector 10 and the branch passage 40. Refrigerant flowing into the ejector 10 is decompressed and expanded by the nozzle 12*a*, and is injected as a refrigerant flow having high speed.

Refrigerant flowing into the branch passage 40 is decompressed by the throttle hole 26*a*, and flows into the first distribution tank 51. Refrigerant is distributed into the first passages 41 represented by the direction I, and gathered into the first gather tank 52. Refrigerant flows into the second distribution tank 53 from the first gather tank 52 in the direction J. Refrigerant is distributed into the first passages 41 represented by the direction K, and gathered into the second gather tank 54.

Refrigerant gathered in the second gather tank 54 is drawn into the suction port 15 in the direction L, due to high speed refrigerant flow injected from the nozzle 12*a*. Refrigerant injected from the nozzle 12*a* and refrigerant drawn through the suction port 15 are mixed in the mixer 17 in the direction M. The speed of refrigerant flow is lowered by the diffuser 18, and refrigerant is discharged from the outlet 19 in a state that the pressure of refrigerant is raised.

Refrigerant passing through the outlet 19 flows into the third distribution tank 55 through the discharge passage 49 represented by the direction N. Refrigerant distributed from the tank 55 is gathered in the third gather tank 56 after flowing through the passages 42 represented by the direction O. Refrigerant flows into the fourth distribution tank 57 from the gather tank 56 through the communication passage 47 represented by the direction P. As shown in the direction Q, refrigerant flows through the second refrigerant passages 42, and is gathered in the fourth gather tank 58. Refrigerant flows into the fifth distribution tank 59 in the direction R. Refrigerant is distributed from the tank 59, and flows through the second passages 42 represented by the direction S. Refrigerant is gathered in the fifth gather tank 60, and flows into the sixth distribution tank 61 in the direction T. Refrigerant is distributed from the tank 61, and flows through the second passages 42 represented by the direction U. Refrigerant is gathered in the sixth gather tank 62, and flows out of the unit 100 from the outlet 21*f* in the direction V.

According to the embodiment, the ejector 10 is arranged outside of the heat exchanger 20, and is fixed to the heat exchanger 20, due to the fix portion 75-77. If an ejector is arranged inside of refrigerant passage, cooling performance of a heat exchanger is lowered in a comparison example. In contrast, according to the embodiment, the cooling performance of the heat exchanger 20 can be secured.

Further, the nozzle portion 11 is arranged between the fix plates 26, 24, and the mixture portion 16 is arranged between the fix plates 24, 25. Therefore, a pipe to connect the ejector 10 and the first header tank 71 is unnecessary. The ejector 10 and the heat exchanger 20 can be integrated with each other in the process for layering the plates 22, 23.

The end parts of the nozzle and mixture portions 11, 16 are inserted into the fix portions 75-77, and the ejector 10 communicates with the first header tank 71 through the passage 40, 48, 49. Therefore, the nozzle and mixture portion 11, 16 are unnecessary to be arranged inside of the header tank 71, such that cross-sectional area of the header tank 71 of the heat exchanger 20 can be increased.

The fix portion 75-77 is arranged in a space between the tanks 43, 44, and the refrigerant passage 41, 42 is not arranged in the space. Therefore, a space for the fix plate 24-26 can be effectively used, so as to construct the fix portion 75-77.

The fix portion 75-77 is located on upper side of the fix plates 24-26 in the vertical direction. Therefore, condensed water generated in the heat exchanger 20 can be drain by gravity force without being intercepted by the ejector 10. Thus, pressure loss can be restricted from increasing, such that the cooling performance of the heat exchanger 20 can be improved.

The nozzle and mixture portions 11, 16 are arranged in the cutout 50 of the heat exchange plates 22, 23 located between the tanks 43, 44. Therefore, a size of the ejector 10 can be restricted from increasing, when the ejector 10 is integrated with the heat exchanger 20.

The end part of the nozzle portion 11 adjacent to the suction port 15 and the end part of the mixture portion 16 adjacent to the suction port 15 are located to be separated from each other. Therefore, the suction port 15 can be defined to be open in a circumference face shape. A member defining the suction port 15 is unnecessary for the ejector 10.

The flange 13*a*, 17*a* is arranged on the first side end of the nozzle and mixture portion 11, 16 in the layering direction A. Therefore, an opening edge face of the fix portion 75, 76 is contact with the flange 13*a*, 17*a* on a plane perpendicular to the inserting direction of the nozzle and mixture portions 11, 16. Thus, brazing can be easily and accurately performed between the nozzle and mixture portion 11, 16 and the fix portion 75, 76.

The fix portion 76, 77 has the opening into which the second side end of the nozzle and mixture portion 11, 16 is inserted. The opening of the fix portion 76, 77 corresponds to the opening of the concave portion 33*g*, 37*g*, and has the edge extending along the outer circumference face of the nozzle and mixture portion 11, 16.

Therefore, the inner circumference face of the opening edge is contact with the outer circumference face of the member 11, 16 in the circumference direction. Thus, brazing can be easily and accurately performed between the nozzle and mixture portion 11, 16 and the fix portion 76, 77. Further, the nozzle and mixture portion 11, 16 connected to the fix portion 76, 77 is supported by the fix portion 76, 77 in a movable state in the longitudinal direction. The nozzle and mixture portions 11, 16 are integrally mounted to the heat exchanger 20 while absorbing parts tolerance and assembling tolerance of the plates 22-26 in the layering direction A, The first fix portion 75 is located upstream of the throttle hole 26*c* in the refrigerant flowing direction. If an amount of refrigerant flowing into the unit 100 has a variation due to a load variation of the refrigerating cycle, refrigerant can preferentially flow into the ejector 10. Therefore, energy recovery of the ejector 10 can be promoted in spite of the load change of refrigerating cycle.

The throttle hole 26*c* has the nozzle shape, thereby refrigerant can easily flow into the first refrigerant passage 41 located far from the throttle hole 26*c*. Further, refrigerant inlet side of the throttle hole 26*c* has a continuation loose curve surface. Therefore, refrigerant can pass through the throttle hole 26*c* without exfoliating, such that noise and vibration of refrigerant flow can be reduced.

The embodiment may have the following modifications, for example.

The predetermined clearance X is defined between the nozzle portion 11 and the mixture portion 16. Therefore, the suction port 15 is defined to open in a side face of a cylinder. Alternatively, plural cutouts having half-elliptical shape may be defined on a refrigerant outlet end of the nozzle portion 11 and a refrigerant inlet end of the mixture portion 16. The suction port 15 may become larger by the size of the cutouts.

An interval between the nozzle portion 11 and the mixture portion 16 may be equal to or smaller than the clearance X. Further, the refrigerant outlet end of the nozzle portion 11 and the refrigerant inlet end of the mixture portion 16 may contact with each other. In this case, the suction port 15 is open in an elliptical shape defined by combining the half-elliptical cutouts. That is, the nozzle portion 11 and the mixture portion 16 may be integrated with each other.

The nozzle portion 11 has the inside tube 12 and the outside tube 13. Alternatively, the nozzle 12*a* may be defined by the outside tube 13 without the inside tube 12.

The flange 13*a* is formed on the first side end of the nozzle portion 11 in the layering direction A. Alternatively, the flange 13*a* may be formed on the second side end of the nozzle portion 11 in the layering direction A. In this case, the flange 17*a* is also formed on the second side end of the mixture portion 16 in the layering direction A. When the flanges 13*a*, 17*a* are located on the same side in the layering direction A, the assembling process can be made easier. Alternatively, the nozzle and mixture portions 11, 16 may be fitted into the fix portion 75-77, thereby the assembling process can be made easier.

The plate longitudinal direction C corresponds to a vertical direction. Alternatively, the plate longitudinal direction C may correspond to a horizontal direction.

The first end of the plate longitudinal direction C corresponds to the upper side in the vertical direction. Alternatively, the first end of the plate longitudinal direction C may correspond to a lower side in the vertical direction. That is, the ejector 10 may be located on a lower side of the heat exchanger 20.

The throttle hole 26*c* has a nozzle shape protruding in the second side of the layering direction A. Alternatively, the throttle may be a mere penetration hole.

Nine of the first heat exchange plates 22 are layered. Alternatively, the number of the plates 22 is not limited to nine. The number of the second heat exchange plates 23 is not limited. However, the number of the plates 22 may be approximately twice of the number of the plates 23, because the header tank 71-74 is divided into three equation parts.

One of the plates 22 has the first board member 31' having the based concave portion 31*a*'. Alternatively, the one of the plates 22 may have a second board member 32' having a based concave portion 32*a*'.

One of the plates 22 has the first board member 31' having the based concave portion 31*b*'. Alternatively, the one of the plates 22 may have a second board member 32' having a based concave portion 32*b*'.

The first fix plate 24 is not limited to be arranged between the plate 22 located the seventh order from the first side and the plate 22 located the eighth order from the first side. Alternatively, the first fix plate 24 may be located at a position at which the suction passage 48 and the second gather tank 54 communicate with each other.

The edge of the opening of the concave portion 33*g* extends along the outer circumference face of the nozzle component 11. Alternatively, the edge of the opening of the concave portion 33*g* may be a mere opening without extending. The concave portion 37*g* may be similar to the concave portion 33*g*.

The end face of the opening edge of the concave portion 33*g* and the second side face of the nozzle portion 11 are located on approximately the same plane. Alternatively, the second side face of the nozzle portion 11 may protrude from the opening edge of the concave portion 33*g*.

The end face of the opening edge of the concave portion 37*g* and the second side face of the mixture portion 16 are located on approximately the same plane. Alternatively, the second side face of the mixture portion 16 may protrude from the opening edge of the concave portion 37*g*.

In the assembling method, the plates 21-26 are layered on the second side plate 27. Alternatively, the distribution plate 21 or the first side plate 26 is prepared, and the plates 22-27 are layered on the second side of the plate 21, 26.

The first side plate 26 has the nail 26*g*. Alternatively, the nail 26*g* may be arranged on the distribution plate 21. If the board member 31-38 has a member corresponding to the nail 26*g*, the process of assembling the plates 22-25 can be easier.

The plate 22, 23, has the cutout 50. Alternatively, the heat exchange plate 22, 23 may not have the cutout 50. In this case, the nozzle and mixture portions 11, 16 may be located above the heat exchange plate 22, 23.

The main groove 21*b* of the distribution plate 21 makes the inlet 21*a* and the concave portion 21*c* to communicate with each other. Alternatively, the inlet 21*a* may communicate with the concave portion 21*e* through the main groove 21*b*. That is, the concave portion 21*e* may be located upstream of the concave portion 21*c* in the refrigerant flowing direction.

Such changes and modifications are to be understood as being within the scope of the present invention as defined by the appended claims.

What is claimed is:

1. An ejector type refrigerating cycle unit comprising:

an ejector having a nozzle to inject refrigerant; and a heat exchanger including a plurality of heat exchange plates stacked with each other, each of the plates having a refrigerant passage through which refrigerant flows to exchange heat with air to be conditioned, each of the heat exchange plates having a tank part in fluid communication with the refrigerant passages; and a header tank defined by the tank parts of adjacent heat exchange plates to connect the refrigerant passages of the plates in a stacked direction of the plates such that the refrigerant passages communicate with each other, wherein at least two of the heat exchange plates are fix plates having a fix portion to fix an end part of the ejector, and a communication portion through which an inside of the ejector and an inside of the header tank communicate with each other, the communication portion having a branch passage which is branched at an upstream side of the nozzle and a decompressor being disposed within the branch passage;

the ejector is arranged between the fix portions of the fix plates in the stacked direction, so as to be integrated with the heat exchanger;

the ejector includes a nozzle portion having the nozzle, and a mixture portion being a separate component from the nozzle portion, a suction port to draw refrigerant using refrigerant flow injected from the nozzle is disposed in a clearance between the nozzle portion and the mixture portion, the mixture portion has an outlet to discharge mixture of refrigerant injected from the nozzle and refrigerant drawn from the suction port, each of the nozzle portion and the mixture portion is arranged between the fix portions of the fix plates in the stacked direction, so as to communicate with the header tank through the communication portion, each of the nozzle portion and the mixture portion is integrated with the heat exchanger; and a heat exchange portion is defined between the decompressor and the suction port, heat is exchanged by refrigerant decompressed by the decompressor in the heat exchange portion; and the suction port is located at an approximate center of the heat exchanger in the stacked direction.

2. The ejector type refrigerating cycle unit according to claim 1, wherein the nozzle portion has an end part located adjacent to the suction port, the mixture portion has an end part located adjacent to the suction port, and the end part of the nozzle portion and the end part of the mixture portion are located to be separated from each other.

3. The ejector type refrigerating cycle unit according to claim 1, wherein the nozzle portion has a flange on a first side in a longitudinal direction of the nozzle portion, the fix portion of the fix plate has an opening through which a second side of the nozzle portion is arranged in the longitudinal direction of the nozzle portion, the flange of the nozzle portion has an outer diameter larger than a diameter of the opening of the fix portion of the fix plate, the fix portion of the fix plate has a protrusion extending from an edge of the opening, and the protrusion has a shape corresponding to an outer circumference face of the nozzle portion.

4. The ejector type refrigerating cycle unit according to claim 1, wherein the mixture portion has a flange on a first side in a longitudinal direction of the mixture portion, the fix portion of the fix plate has an opening through which a second side of the mixture portion is arranged in the longitudinal direction of the mixture portion, the flange of the mixture portion has an outer diameter larger than a diameter of the opening of the fix portion of the fix plate, the fix portion of the fix plate has a protrusion extending from an edge of the opening, and the protrusion has a shape corresponding to an outer circumference face of the mixture portion.

5. The ejector type refrigerating cycle unit according to claim 1, wherein each of the heat exchange plates is defined by stacking at least two board members in the stacked direction, and the refrigerant passage, the fix portion and the communication portion are defined by stacking the board members.

6. The ejector type refrigerating cycle unit according to claim 1, wherein one of the heat exchange plates located most outside has a first fix portion through which an end part of the nozzle portion is arranged in a longitudinal direction of the nozzle portion, and the branch passage through which refrigerant flows into the header tank from the first fix portion by bypassing the nozzle portion, the first fix portion and the branch passage are defined by stacking a first side plate and a distribution plate, the first side plate strengthens the heat exchanger, and the distribution plate has a groove defining the branch passage.

7. The ejector type refrigerating cycle unit according to claim 6, wherein the first side plate has the decompressor to decompress refrigerant to flow into the header tank.

8. The ejector type refrigerating cycle unit according to claim 1, wherein a suction passage is defined in the heat exchange plates adjacent to a position where the nozzle portion is separated from the mixture portion to define the clearance and the refrigeration passage communicates with the ejector through the suction passage.

9. The ejector type refrigerating cycle unit according to claim 1, wherein the clearance is defined by one of the fix plates.

10. The ejector type refrigerating cycle unit according to claim 1, wherein the nozzle is two components separated by one of the fix plates.

11. The ejector type refrigerating cycle unit according to claim 1, wherein the nozzle portion communicates with the mixture portion across the clearance.

12. The ejector type refrigerating cycle unit according to claim 11, wherein the clearance is defined by one of the fix plates.

13. The ejector type refrigerating cycle unit according to claim 1, wherein the nozzle portion is attached directly to a first wall of one of the fix plates, the mixture portion is attached directly to a second wall of the one of the fix plates and the clearance extends between the first and second wall of the one of the fix plates.

14. The ejector type refrigerating cycle unit according to claim 1, wherein the decompressor, the suction port and the outlet of the mixture portion are positioned on a first side of the heat exchanger in a longitudinal direction of the heat exchanger, the longitudinal direction being perpendicular to the stacked direction.

15. The ejector type refrigerating cycle unit according to claim 1, wherein the heat exchange portion is defined only inside a leeward core of the heat exchanger and the heat exchange portion is directly connected to the decompressor and is directly connected to the suction port.

* * * * *